US009108458B2

(12) United States Patent
Ponti

(10) Patent No.: US 9,108,458 B2
(45) Date of Patent: Aug. 18, 2015

(54) APPARATUS FOR CHANGING AN ADVANCEMENT DIRECTION OF PILES OF INSERTS TO BE STUFFED IN ENVELOPES

(75) Inventor: Francesco Ponti, Citta di Castello (IT)

(73) Assignee: C.M.C. S.r.l., Cerbara-Citta di Castello (Perugia) (IT)

( * ) Notice: Subject to any disclaimer, the term of this patent is extended or adjusted under 35 U.S.C. 154(b) by 0 days.

(21) Appl. No.: 14/342,703

(22) PCT Filed: Sep. 7, 2012

(86) PCT No.: PCT/IB2012/054635

§ 371 (c)(1),
(2), (4) Date: Mar. 4, 2014

(87) PCT Pub. No.: WO2013/035075

PCT Pub. Date: Mar. 14, 2013

(65) Prior Publication Data

US 2014/0231218 A1 Aug. 21, 2014

(30) Foreign Application Priority Data

Sep. 9, 2011 (IT) ..... BO2011A0516

(51) Int. Cl.
*B43M 3/04* (2006.01)
*B65H 5/06* (2006.01)
(Continued)

(52) U.S. Cl.
CPC ..... *B43M 3/04* (2013.01); *B65H 5/062* (2013.01); *B65H 29/12* (2013.01); *B65H 29/125* (2013.01); *B65H 31/3009* (2013.01); *B65H 31/3027* (2013.01); *B65H 2301/3121* (2013.01); *B65H 2301/321* (2013.01); *B65H 2301/33212* (2013.01); *B65H 2301/33214* (2013.01); *B65H 2301/33222* (2013.01); *B65H 2301/3411* (2013.01); *B65H 2301/3422* (2013.01); *B65H 2301/34112* (2013.01);
(Continued)

(58) Field of Classification Search
CPC ..... B43M 3/00; B65H 5/062; B65H 29/125; B65H 2301/321; B65H 2301/3411; B65H 2404/1112; B65H 2404/2611
USPC ..... 198/608, 624; 270/58.06; 271/177, 184, 271/225, 277
See application file for complete search history.

(56) References Cited

U.S. PATENT DOCUMENTS 5,899,318 A 5/1999 Schwer et al.
6,951,333 B2 * 10/2005 Gosslinghoff ..... 271/177
(Continued)

*Primary Examiner* — Leslie A Nicholson, III
(74) *Attorney, Agent, or Firm* — R. Neil Sudol; Henry D. Coleman

(57) ABSTRACT

An apparatus for changing, in an envelope stuffing machine, an initial advancement direction of piles made up of inserts to be put in envelopes comprises at least a thrust device for pushing a pile in a thrust direction perpendicular or oblique with respect to an initial advancement direction, and at least a connecting device comprising drawing means for transporting piles along a transport pathway at a terminal end of which there is an outlet of the connecting device, the drawing means receiving piles which are supplied in initial advancement direction, the drawing means being curved so that the transport pathway comprises at least an arced tract with a center of curvature on a main axis perpendicular to the initial advancement direction, whereby, upon crossing the arced tract, the piles exhibit an intermediate advancement direction oblique or transverse to the initial advancement direction; the thrust device being downstream of the connecting device so as to receive piles which exit from the connecting device.

4 Claims, 7 Drawing Sheets

(51) Int. Cl.
*B65H 29/12* (2006.01)
*B65H 31/30* (2006.01)

(52) U.S. Cl.
CPC ..... *B65H 2301/42262* (2013.01); *B65H 2301/4474* (2013.01); *B65H 2404/1112* (2013.01); *B65H 2404/147* (2013.01); *B65H 2404/2611* (2013.01); *B65H 2701/18262* (2013.01); *B65H 2801/66* (2013.01)

(56) References Cited

U.S. PATENT DOCUMENTS

| | | | | |
|---|---|---|---|---|
| 7,124,877 | B2 * | 10/2006 | Honegger | 198/608 |
| 7,380,790 | B2 * | 6/2008 | Farmer et al. | 271/306 |
| 2004/0108643 | A1 * | 6/2004 | Pittelkow et al. | 270/58.06 |
| 2005/0093225 | A1 | 5/2005 | Honegger | |

* cited by examiner

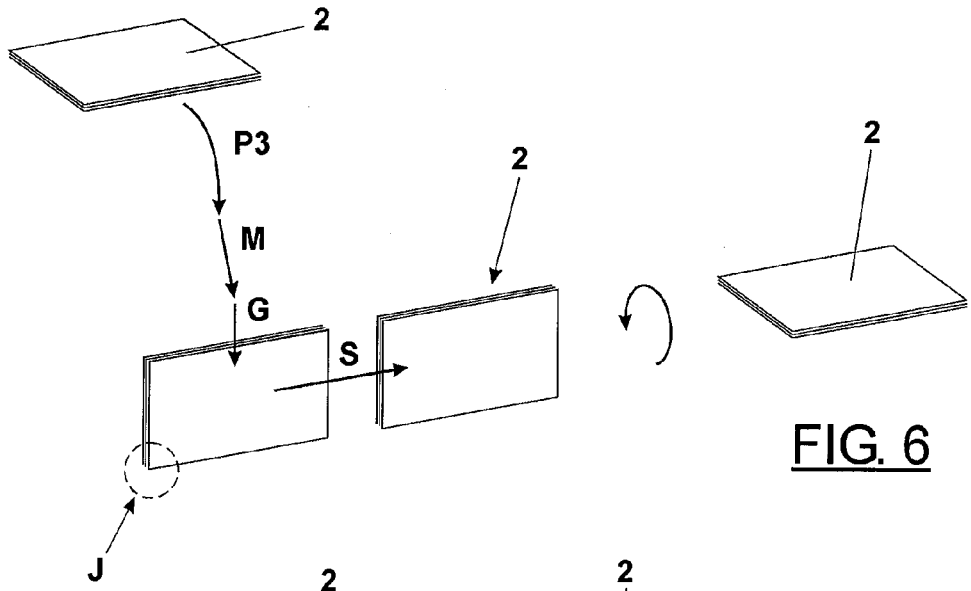
FIG. 6
FIG. 7
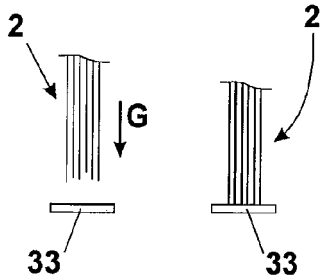
FIG. 7'
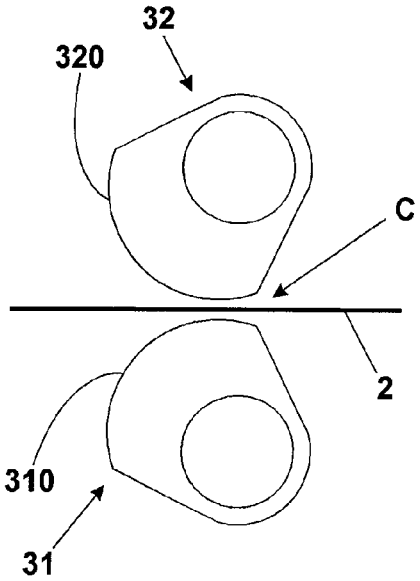
FIG. 8
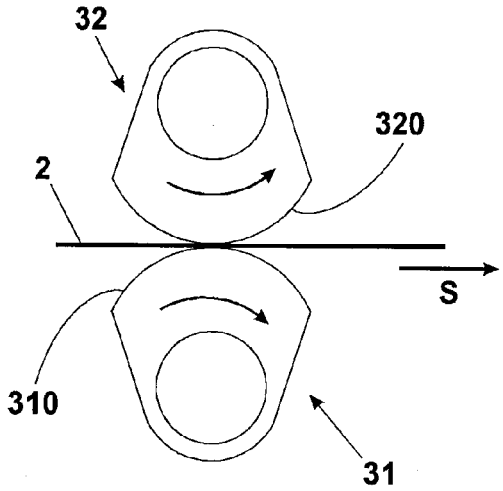
FIG. 9

APPARATUS FOR CHANGING AN ADVANCEMENT DIRECTION OF PILES OF INSERTS TO BE STUFFED IN ENVELOPES

FIELD OF THE INVENTION

The invention relates to stuffing piles of sheets and/or other inserts in envelopes.

In detail, the invention relates to an apparatus for changing an advancement direction of the piles, destined for use in a stuffing machine.

DESCRIPTION OF THE PRIOR ART

Stuffing machines are very widely used in the publicity mailing sector, or in general in the field of transmission of information by post, which comprises correspondence on commission services for banks, post offices, telephone companies, council administrations, and so on.

Stuffing machines of known type comprise a pile-forming station, in which the sheets that go to make up the piles are formed, each of which, at the end of the storing operation, forms a pile to be stuffed in envelopes.

In detail, the piles are formed by means of a succession of sheet-placing devices, which release a respective sheet onto the pile under formation as it advances by means of a conveyor in the pile forming station.

These machines further comprise an envelope stuffing station, to which the formed piles are supplied, one at a time, by a linear conveyor which connects the forming station to the stuffing station, arranged in series to the conveyor, where the piles are inserted in the respective envelopes by stuffing apparatus.

At present these stuffing machines have a considerable number of sheet-placing devices and, given that they are to be arranged in series, the machines have a considerable longitudinal development.

Further, as is known, stuffing machines are modular and therefore the forming station of the piles and the stuffing station, for example, are modules that can be separated.

It can occur that a mailing company has to replace the stuffing station of its machines with a different type, which, for example, has a geometry and a size that is such as to create problems of positioning of the various machines and apparatus in the rooms they are located in.

For example, the company might have to replace a stuffing station having a stuffing apparatus of the type which inserts the piles in preformed envelopes, with a continuous stuffer, i.e. a stuffing station in which the relative stuffing apparatus insert the piles in a continuous paper tube which is then cut transversally such as to form, after a gluing operation, the envelopes containing the relative piles.

Continuous stuffers have a longitudinal development that is greater than the preformed-enveloped stuffers, which makes the above problem more acute.

SUMMARY OF THE INVENTION

The aim of the present invention is to obviate these drawbacks and others besides, by providing an apparatus usable in an envelope-stuffing machine for changing the initial advancement direction of piles made up of inserts to be stuffed, as set down in claim 1.

The apparatus of the invention comprises:

at least a thrust device for pushing a pile in a pushing direction, arrangeable in such as way that the pushing direction is perpendicular or oblique with respect to the initial advancement direction, and at least a connecting device comprising drawing means for transporting piles along a transport pathway, at a terminal end of which transport pathway there is an outlet of the connecting device, which drawing means are suitable for receiving piles which are supplied to the apparatus having said initial advancement direction, the drawing means being curved in such a way that the transport pathway comprises at least an arced tract with a centre of curvature located on a main axis perpendicular to the initial advancement direction, whereby, upon the crossing of the arced tract, the piles exhibit an intermediate advancement direction which is oblique or transversal with respect to the initial advancement direction.

The invention further comprises a thrust device which is located downstream of the connecting device, in a position in which it can receive the piles exiting from the connecting device.

As the apparatus of the invention comprises a thrust device able to push the pile in a perpendicular or oblique direction with respect to the initial advancement direction with which the formed pile is made to advance in the stuffing machine in a section upstream of the apparatus, the apparatus enables arranging the sections of the machine downstream of the apparatus such that they have an inclined longitudinal development (i.e. oblique or actually transversal) with respect to the part of the machine upstream of the apparatus.

In this way, the longitudinal development of all the machine is not in line, but is angled, such as to reduce the lengthwise volume of the apparatus.

BRIEF DESCRIPTION OF THE DRAWINGS

Specific embodiments of the invention will now be described in the following, according to what is set out in the claims and with the aid of the accompanying figures of the drawings, in which:

FIG. 6 is a schematic view of the movement of a pile in a part of the apparatus;

FIGS. 7 and 7' are detail J in larger scale, taken from the preceding figure, in two different moments;

FIGS. 8 and 9 are a schematic view from above of the thrust device, represented in two successive moments.

DESCRIPTION OF THE PREFERRED EMBODIMENTS

Figure 1:
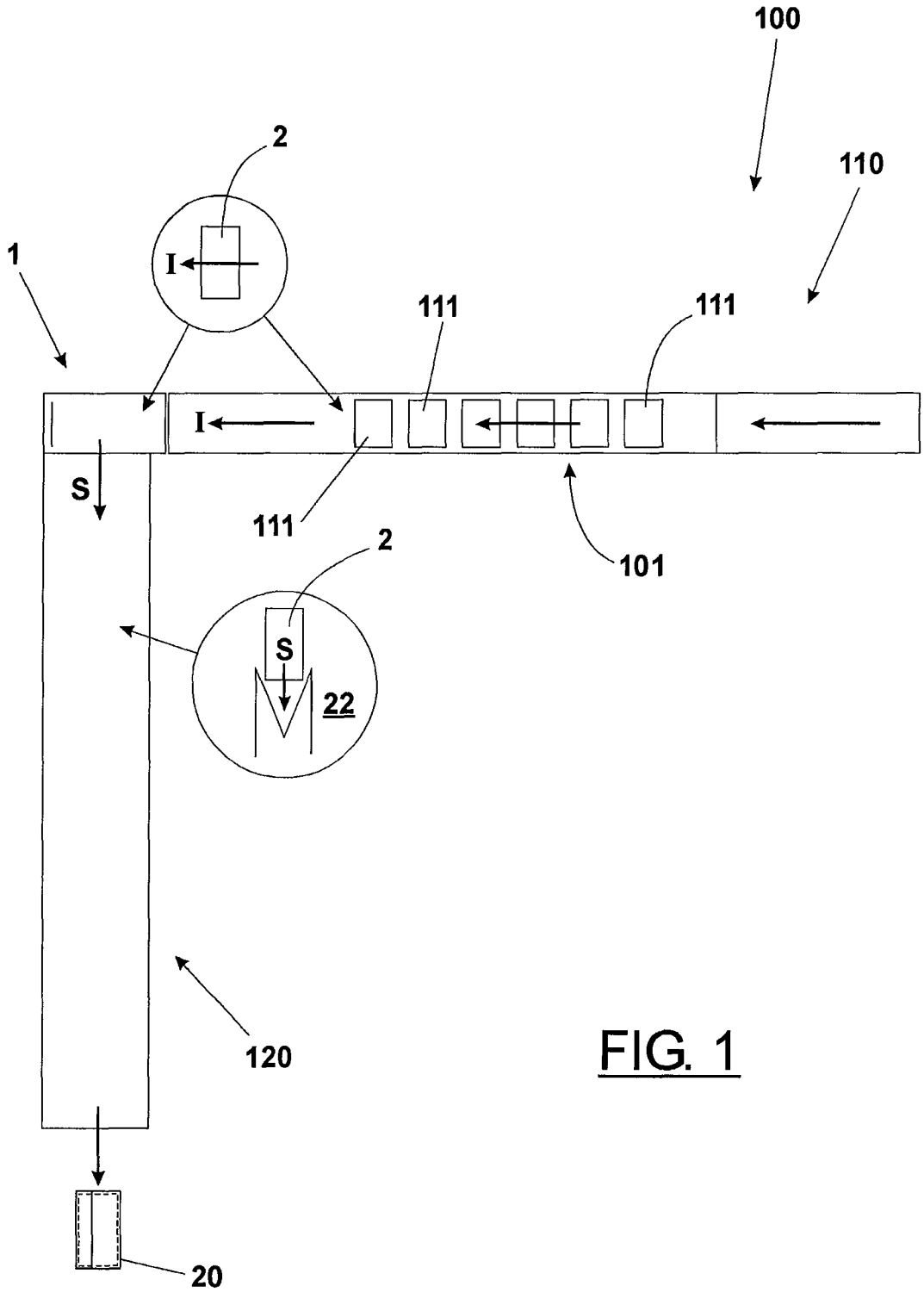
FIG. 1 is a schematic view from above of a stuffing machine in which the apparatus of the invention can be used.

The apparatus of the invention is indicated with 1 in the accompanying drawings.

Before detailing the structure and functioning of the apparatus 1, a brief description will be given, with reference of FIGS. 1 and 2, of a stuffing machine 100 in which the apparatus 1 can be used.

The machine 100 comprises an initial section 110 which comprises the pile-forming station 101, in turn comprising a series of sheet-placing devices 111, arranged in a line, the formed piles 2 exiting at an end of which station 101.

In general the machine 100 comprises, as is known, a series of benches 1000 on which the conveyors and devices used are mounted.

For reasons of ease, in the initial section 110 (but also in the final section 120, as will emerge), and at least initially, the piles 2 are transported in a horizontal direction and also arranged horizontally, i.e. the sheets making up the pile are each arranged horizontally.

In fact, generally the has a substantially parallelepiped shape.

In the following, when we refer to the pile as being horizontal, we mean that the extension of the pile, in the dimensions of length and breadth thereof, is horizontal and the thickness is transversal thereto and therefore vertical.

Consequently, when we state that it is in a vertical position, it means that the pile has the length or width thereof orientated vertically.

As clearly shown in FIG. 1, the piles 2 can be supplied to the apparatus 1 orientated with the length transversal to the initial direction of advancement I, meaning the advancement direction the piles have at the end of the initial section 110 when they are sent in inlet to the apparatus 1.

On exiting the apparatus 1, piles 2 are advanced according to the thrust direction S which in the preferred embodiment shown is perpendicular to the initial one I.

When the direction change of the pile advancement 2 has been carried out (preferably by ninety degrees, as will be explained), which is the exact aim of the invention, the piles 2 are delivered to the final section 120 of the machine 100 which, as can be seen in FIG. 1, has a length transversal to the length of the initial section 110, such as to obviate the drawbacks in the prior art.

The stuffing station is present in this final section 120, and is not illustrated except schematically in FIG. 1, where the pile 2 can be seen entering an open envelope 22 following the thrust direction S.

At the end of the final section 120, i.e. at the exit of the machine 100, the closed envelope 20 containing the pile is produced.

For reasons that will become clear after the description of the functioning of the invention, the pile 2 supplied to the apparatus 1 with the length thereof transversal to the advancement direction (in this case, the initial direction I), after passing into the apparatus 1 can have a length that is parallel to the advancement direction (which is the thrust direction S or a continuing direction parallel thereto).

In this case, the pile 2 is supplied in exit from the apparatus 1 with an optimal orientation for stuffing thereof in a continuous stuffing machine, as known to the expert in the sector.

Figure 2:
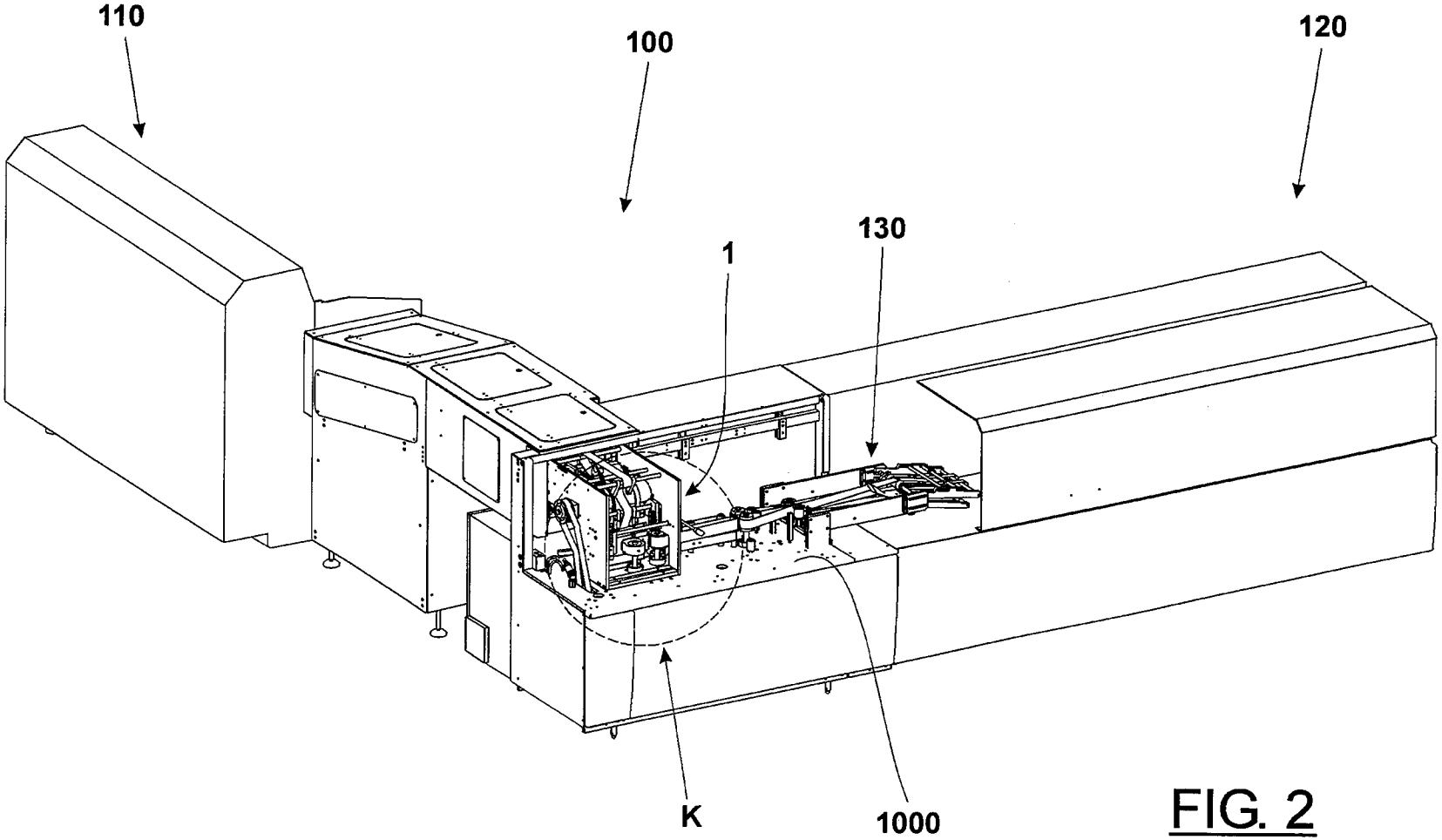
FIG. 2 is an axonometric view of a stuffing machine in which the apparatus of the invention can be used.

In FIG. 2 it can be observed how the apparatus 1 can be positioned in the machine 100, i.e. at a corner thereof; in practice, the apparatus 1 itself defines a corner of the machine 100.

The same figure also illustrates a pile-rotating device which, as will become clear in the following, can optionally be part of the apparatus 1.

Figure 3:
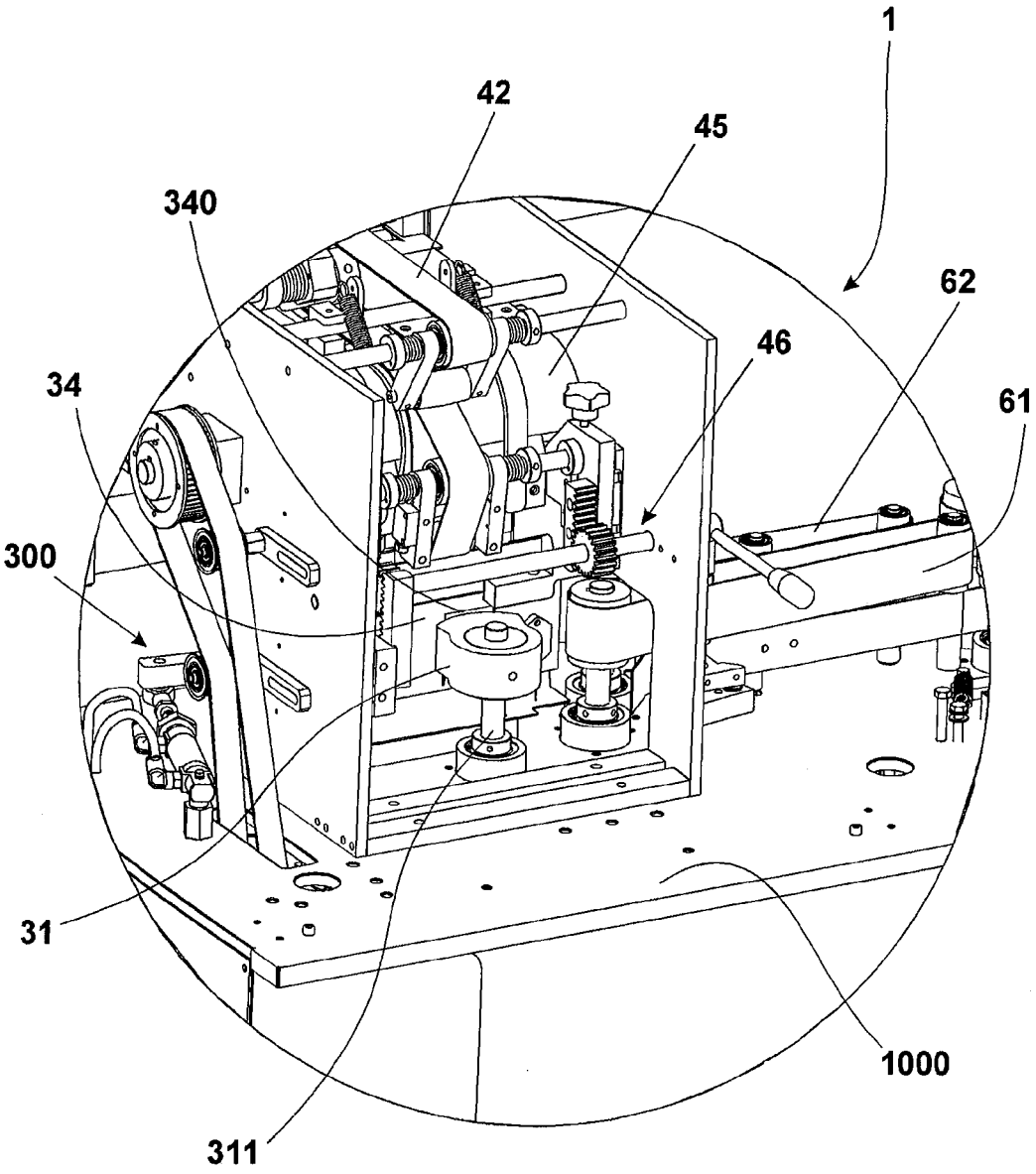
FIG. 3 is detail K, enlarged, of the preceding figure.

In the following reference will be made in particular to the detailed FIGS. 3, 4, 5 and 5' in order to describe the structure and functioning of the apparatus 1, and also to the schematic FIGS. 6, 7, 7', 8 and 9 as an aid to understanding the functioning.

The apparatus 1 of the invention 1 comprises, as mentioned, primarily a thrust device 21, 32 for pushing a pile 2 in the thrust direction S, which device 21, 32 is arrangeable such that the thrust direction S is perpendicular or oblique to the initial advancement direction I.

Figure 4:
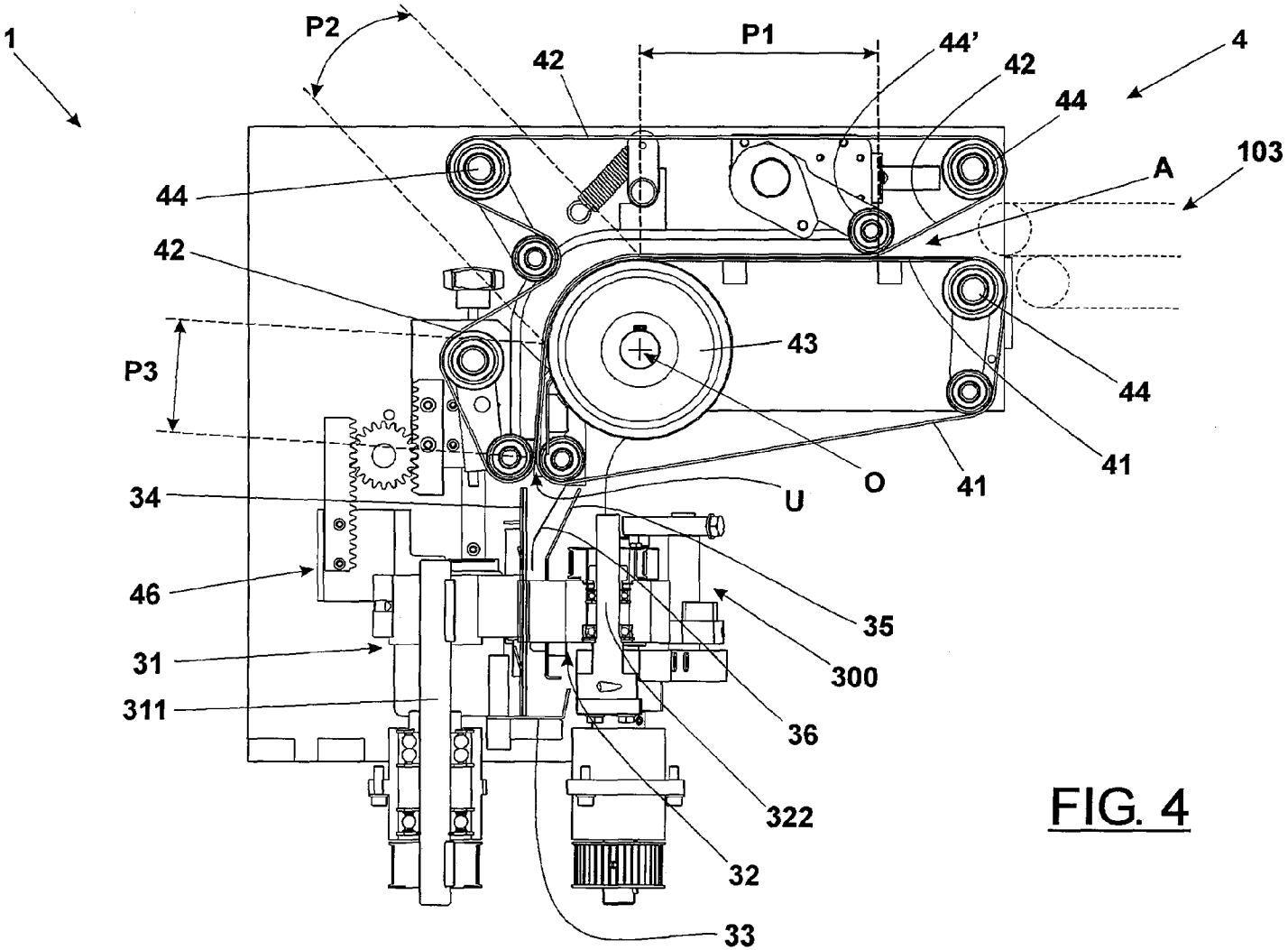
FIG. 4 is a section view of the apparatus of the invention, the section of which is taken on a median vertical plane.

Further, the invention comprises the fundamental connecting device 4, which in turn comprises drawing means 41, 42 for transporting piles 2 along a transport pathway P1,P2,P3, at a terminal end of which transport pathway there is an outlet U of the connecting device (see FIG. 4).

The drawing means 41, 42 can have various versions (in the following the preferred version will be described) but in general they are suitable for receiving piles 2 which are fed to the apparatus 1 (normally one at a time) having the above-mentioned initial advancement direction I.

In practice, the inlet A of the connecting device 4 is generally the inlet of the apparatus 1.

At the inlet A, the piles are fed from the section of the machine 100 upstream of the apparatus 1, for example by a pair of belts 103, such as the ones schematically illustrated in FIG. 4.

The drawing means 41, 42 are curved such that the transport pathway comprises an arced tract P2 having a centre of curvature located on a main axis O perpendicular to the initial advancement direction I, from which, following the crossing of the arced tract P2, the piles 2 exhibit an intermediate advancement direction M which is oblique or transversal to the initial advancement direction I.

In the following, the preferred version of the connecting device 4 is described, together with some optional aspects thereof.

As can be seen from the figures, the transport means preferably comprise two parallel drawing belts 41, 42 arranged facing one another over a given length P1,P2,P3 such as to define the transport pathway, along which the piles 1 to be drawn can be received between two belts 41, 42.

Before entering into the constructional details, the general functioning of the device 4 will be clarified.

The piles arrive one at a time at the inlet A of the apparatus 1, and are collected by the pair of opposite belts 41, 42, i.e. they are gripped between the two belts, which move in the same direction, drawing the piles 2 along the transport pathway P1,P2,P3; the belts 41, 42 together define a means which solidly grip and draw the piles 2.

Note that the inlet A is defined by the point in which the belts 41, 42 converge up to adhering.

The gripped pile (or the piles, according to the size of the single pile and the length of the transport pathway) is drawn along the transport pathway P1,P2,P3, which comprises an arced tract P2, after which the pile 2 will have taken on a new advancement direction M (termed "intermediate" herein).

For the sake of precision, the preferred and most efficient functioning is as follows.

The piles 2 progressively arrive, often with a horizontal orientation and with an initial horizontal advancement direction I, and then, following the passage through the arced tract P2, take on an advancement direction which is inclined downwards (and thus at least oblique to the initial direction I), but are always perpendicular to the main axis O.

The main axis O is preferably horizontal, the arced tract P2 extends in the lower semi-space, defined below the initial direction I, and the angular length thereof can be ninety degrees, such that the pile 2 can take on a vertical orientation or an oblique orientation with respect to the vertical, in order to be released beneath the connecting device.

From the constructional point of view, this functioning can be obtained in the following way.

The belts are in practice a lower belt 41 and an upper belt 42, which is superposed on the lower belt 41 along the transport pathway P1,P2,P3, where the two belts are in strict adherence to one another.

Further, the connecting device 4 can comprise a main roller 43, preferably motorised, the axis of symmetry of which, and the rotation axis of which, coincides with the main axis O, the two belts, upper and lower 41, 42, being curved against the lateral surface of the roller 43 (or rather a portion thereof) so as to define the arced tract P2, as is clear from FIG. 4.

In practice, the pair of belts 41, 42, facing and adhering and the main roller 43 are arranged with respect to one another in such a way that the pair of belts 41, 42 bend because the lower belt 41 abuts against the roller 43 and the upper belt 42 abuts against the lower one, to define, along the contact surface, the curved tract P2.

An expert in the sector will understand how to position the various secondary rollers 44, 44' such that the two belts 41, 42, loop-wound, adhere for a transport pathway P1,P2,P3 defined according to the teachings now disclosed.

For example, the secondary rollers 44, 44' can be arranged exactly as in the accompanying figures of the drawings.

In particular, the upper secondary idle roller 44', which contributes to defining the inlet A (see FIG. 4), can be mounted on an oblique arm with respect to the initial advancement direction I, with an adjustable inclination, which arm 440 can be elastically connected to the rest of the apparatus 1.

The only motorisation of the connecting device 4 is preferably the main roller 43, which draws in rotation the lower belt 41, which in the illustrated example is wound about it, comprising it in the loop thereof, which lower belt 41 draws the upper belt 42 thanks to the friction exerted along the transport pathway P1,P2,P3.

The preferred constructed version of the connecting device 4 comprises some further particulars.

Firstly, the belts 41, 42 together define an initial tract P1 of the transport pathway, arranged upstream of the arced tract P2, which initial tract P1 (preferably horizontal) has a first end A which corresponds to the inlet of the apparatus 1.

In detail, the longitudinal orientation of the belts 41, 42 in the initial tract P1 is in the initial advancement direction I, such that the piles 2 are transported along the initial tract P1, maintaining the initial advancement direction I (then to change direction after the arced tract P2).

Further, downstream of the arced tract P2, the belts 41, 42 diverge such as to define a final end U of the transport pathway, which is also the above-mentioned outlet of the connecting device 4, such that a pile of sheets 2 drawn by the belts 41, 42, can be released by gravity following crossing thereof of the outlet U.

In greater detail, downstream of the arced tract P2 and up to the final end of the transport pathway U, the belts 41, 42 are arranged with the length thereof orientated in such a way as to define a final tract P3 of the transport pathway which is either vertical or oblique with respect to the vertical (see FIG. 4), the final end U being located in the lower semi-space defined by an ideal horizontal plane passing through the main axis O.

When the tract P3 is oblique, it preferably has an inclination, with respect to the vertical, of less than 45 degrees.

A device 4 made in this way enables the piles 2 to be gripped one at a time and, keeping them together, to be taken to a lower level where they assume an intermediate direction M which takes them downwards, then to be released by gravity below the connecting device, clearly with the aim of delivering them to the thrust device 31,32,33,34 described in the following.

In the preferred embodiment described here, we note that the connecting device 4 takes the horizontal piles, arranged with the length parallel to the advancement direction I, and supplies them in outlet U arranged either vertical or oblique with respect to the direction of gravity G, with the length parallel to the intermediate direction M.

After this, as soon as the piles are released they are subjected only to gravity, up until they arrive at the thrust device 31,32,33,34 (see FIG. 6).

As mentioned above, the thrust device 31,32,33,34 is downstream of the connecting device 4 and if the connecting device 4 releases the piles by force of gravity, as in the above-detailed preferred embodiment, the thrust device will be positioned below the connecting device.

Before describing the thrust device 31,32 in detail, a further particular of the invention will be described, illustrated in FIG. 3.

At the sides of the main roller 43, at least an abutting element 45 is arranged in a flanked and parallel position with respect to the pair of belts 41, 42 in the curved tract P2, the abutting element 45 having a cylindrically-developing shape, the lower concave surface whereof is destined to superiorly abut a pile 2 transported by the belts 42, 43 such as to entirely guarantee the stability of the transport; in effect it functions as a guide.

In practice, this abutting element 45 (which can be two in number, one for each flank of the pair of belts 41, 42) has a lower surface that is located on the ideal lateral surface of a cylinder having the main axis O as an axis of symmetry, and is at a distance from the axis O which is such as to be able to abut a pile passing through the curved tract P2.

As mentioned above, and as shown in the figures, the thrust device 31,32,33,34 is preferably located below the connecting device 4, such as to be able to receive the pile released by force of gravity therefrom.

We clarify that the thrust device is preferably fixed directly on the bench 1000 of the machine 100, while the overlying connecting device 4 is mounted such as to be height-adjustable.

In practice, the apparatus 1 can comprise means (indicated only generally by numeral 46 in the figures, as it is known to the expert in the sector) for varying the height of the connecting device 4, by vertical translations.

In this way, the apparatus 1 can process piles 2 having different dimensions.

In the preferred embodiment, the thrust device comprises two thrust elements 31, 32 rotatable about a respective vertical rotation axis, and each having a thrust surface 310,320.

In particular, the two thrust elements 31, 32 are arranged with respect to one another in such a way that following the activating in counter-rotation of the two thrust elements, the respective thrust surfaces 310, 320 are cyclically facing one another (see FIG. 9) and at such a distance as to be able to take a pile 2 and push it together in the thrust direction.

In practice, when a pile 2 exits from the connecting device 4, it is presented to the thrust device between the thrust elements 31, 32, which act in counter-rotation such as to push the pile in the thrust direction S, towards the outside of the apparatus 1, i.e. a direction which is inclined (for example by 90 degrees, as will be seen) with respect to the initial advancement direction I of the pile, thus achieving the aims of the invention.

Before describing in detail the structure of the thrust elements 31, 32 (which are preferably the same), in a preferred embodiment, we now describe the functioning of the thrust device, with the aid of figures from 3 to 9.

With reference to FIG. 4, it can be seen that following the exit of a pile 2 from the outlet U of the connecting device, it falls by force of gravity into the thrust device 31, 32, 33, 34, between the two thrust elements 31, 32 up to abutting with a fixed lower base 33 located below the thrust surfaces 310, 320 of the thrust elements, and destined to restingly receive a side of the pile 2.

The base 33 is preferably horizontal.

In practice, if originally the pile 2 before entering the apparatus 1 was horizontal when it falls on the base 33 it is vertical and is therefore arranged jack-knifed with respect thereto, i.e. it is transversal thereto.

In particular, if the pile 2 was originally travelling with the length orientated perpendicularly to the initial advancing direction I, when it arrives on the base 33 it will abut against the base 33 with the thickness of one of its larger sides (still with reference to the parallelepiped shape thereof) and with the length already orientated in the thrust direction S.

When the pile abuts on the base 33, the sheets (or other inserts), an edge of which singly abuts the base 33, advantageously even up (see FIG. 7 and FIG. 7') in the sense that the edges become coplanarly arranged, such that a pile 2 that has become disarranged during the preceding transport takes on a more coherent configuration that is suitable for easy insertion in the envelope it is destined for.

When the pile 2 is in this position above the base 33, the thrust elements 31,32 can rotate about the axis thereof such that the thrust surfaces 310, 320 thereof abut the opposite larger sides of the pile 2, pushing the pile 2 in the thrust direction (see FIGS. 6, 8 and 9 once more).

It is clear that the rotation cadence of the main roller 43 and the thrust elements 31, 32 can be coordinated, either electronically or mechanically, such that the functioning thereof is always in a desired step, for example such that as soon as a pile touches the base 33, it is immediately pushed away.

The thrust elements 31, 32 can be activated in rotation for example by means of a crank mechanism such as the one denoted by numeral 300 in the figures.

In order that this solution can function with top efficiency, the thrust elements can be cam-shaped 31, 32 and horizontally arranged, each for example fixed above a vertical rotation shaft 311, 322; in particular, the rotation axis thereof can pass through the respective lobe, with the remaining portion of the cam constituting a projecting protrusion having a lateral periphery which defines the above-mentioned thrust surface 310, 320 (which preferably is shaped as an angular sector of the lateral surface of a cylinder).

In this way the following functioning is possible.

When the pile falls from the connecting device 4, it can pass freely between the thrust elements 31, 32, in a central space C, as the elements 31, 32 are commanded, during this step, such as to be axially concurrent, with oblique or transversal axes, i.e. such as to have the protrusions displaced from the central space C (see FIG. 8).

In the immediately following step, the elements 31, 32 rotate in counter-rotation, such as to bring the protrusions into the central space C where the pile 2 is located, with the thrust surfaces of the cam elements 31, 32 going to grip the pile solidly when the elements 31, 32 are coaxial, then to push it away while they continue in the respective rotation thereof (FIG. 9).

It is clear that it is not a necessary principle for the thrust elements 31, 32 to cease to rotate between the pile-receiving step (though an alternative functioning can be applied, as will emerge in the following).

This type of functioning can be actuated even if the thrust elements 31, 32 are not cam-shaped as long as each has a projecting protrusion the lateral periphery whereof defines the thrust surface 310, 320.

When the thrust elements 3132 are realised in this way, a lateral side-board 34 can advantageously be provided, located below the connecting device 4, and arranged superiorly of the lower base 33, in a position such as to encounter a pile 2 when it is resting on the base 33, such as to prevent its falling (see FIGS. 3 and 4) in the preceding step to the thrust step, i.e. when waiting for the pile to be thrust away by the elements 31, 32.

This side-board 34 will preferably be vertical, and placed in front of one of the thrust elements 31, in which case an opening 340 will be provided, such as a window, suitable for enabling the thrust surface 310 of the element 31 to contact the pile because of the thrust.

In detail, to keep the piles in position, elastic contrast means 36 can be provided, for example in the form of one or more harmonic steel plates, positioned in front of the side-board 34 and suitable for pressing the pile against it.

In particular the means 36 can also function as a deflector, and therefore have a superior portion that is oblique with respect to the vertical, which switches the piles 2 falling from the connecting device and accompany them in proximity of the side-board 34, then pressing them against the side-board 34.

In detail, providing the contrast means 36 has a further advantage.

The thrust device can be destined to allow several piles to accumulate, one flanked to another, above the base 33, and kept for a short time together by the contrast means 35, up to when the thrust elements 3132 are commanded such as to push them away.

In this case, clearly, the thrust elements are activated in step fashion, with an operating pause step, during which the piles accumulate.

A second edge 35 can further be faced parallel to the above-mentioned lateral side-board 34, and located at a distance therefrom such as to define the maximum accumulation space of the piles on the base 33.

The second edge can be located in front of the thrust element denoted by 32 in the figures and comprise an opening to enable the thrust surface 320 to abut the pile 2 when it has to push it.

To guarantee that the thrust direction S is exactly perpendicular to the initial direction I, the thrust devices 31, 32 are preferably positioned such that the ideal plane comprising both the vertical rotation axes thereof is perpendicular to the above-mentioned main axis O.

In a special embodiment, the apparatus 1 can further comprise a pile-rotating device 130.

In fact, as mentioned herein above, in a case in which in the sections of the stuffing machine 100 upstream of the apparatus the piles are moved horizontally-arranged, the apparatus 1, the connecting device 4 and the thrust device can be configured and arranged such that the pile exits arranged vertically from the apparatus 1.

In order to stuff the pile, for example by means of a continuous stuffer, the pile should preferably be horizontally arranged.

Figure 5:
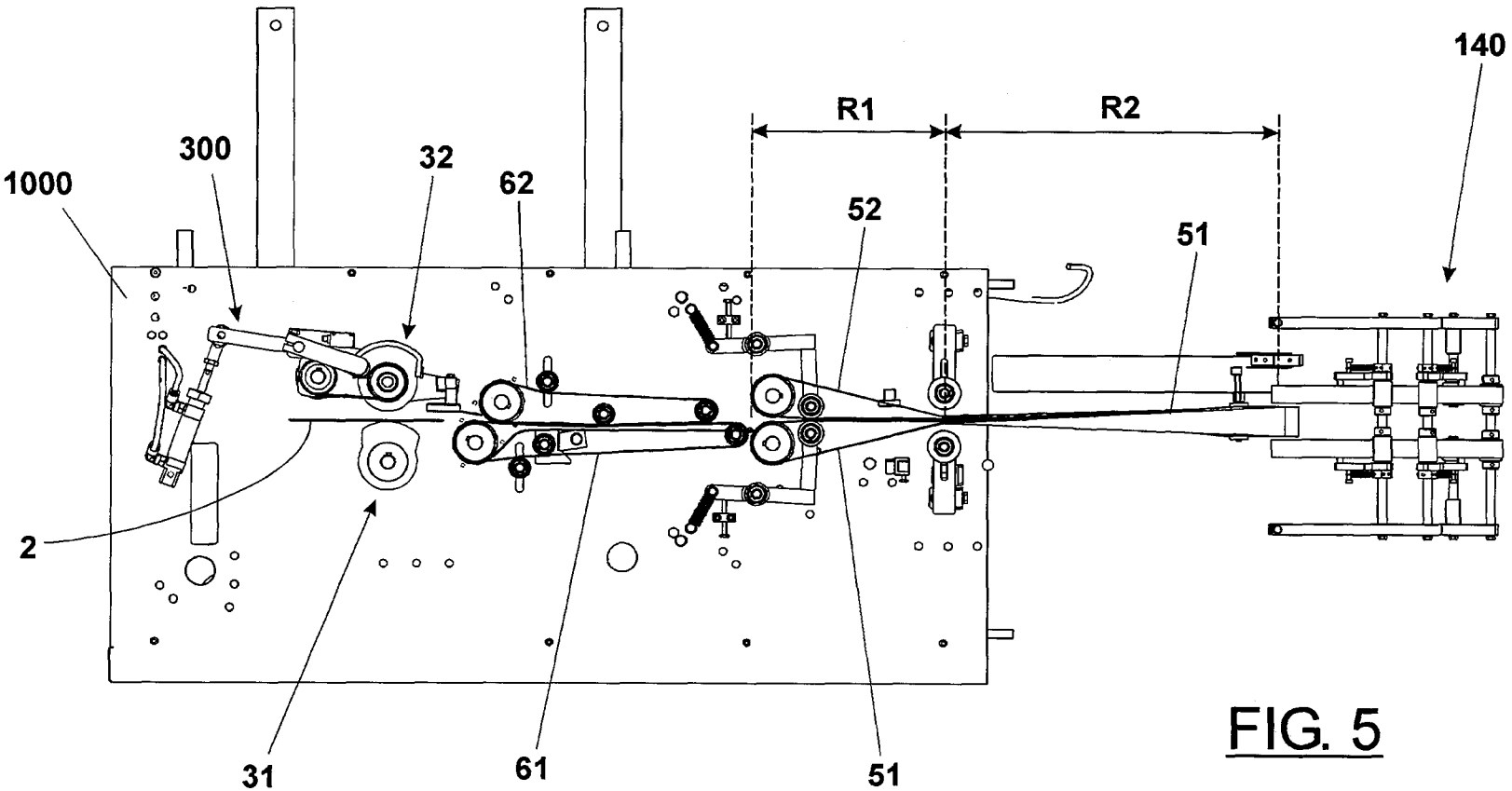
FIGS. 5 and 5' are a view from above and an axonometric view of a part of the apparatus according to a special embodiment.
Figure 5:
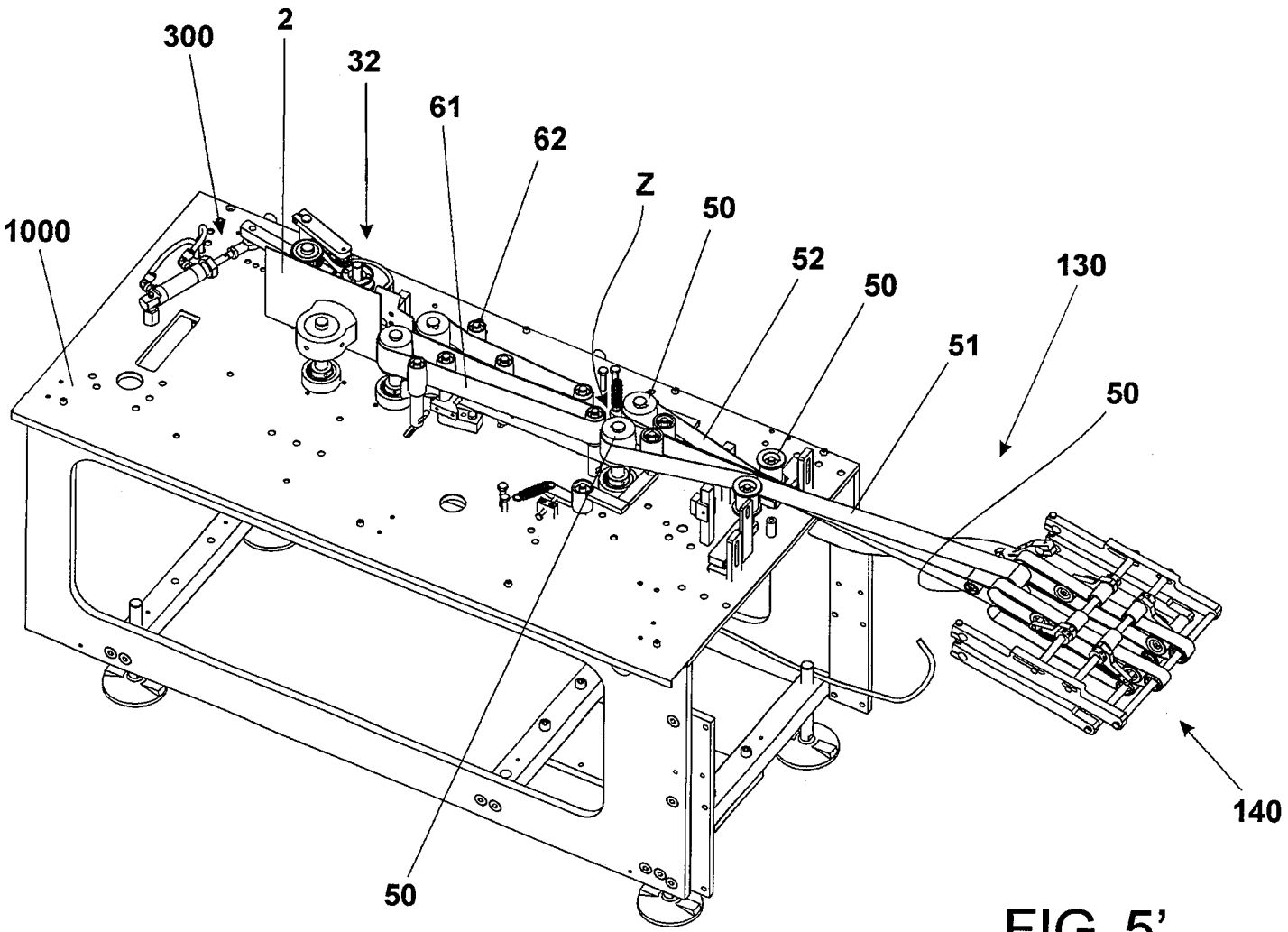

Consequently, the apparatus can preferably comprise, apart from the connecting device 4 and the thrust device 31, 32, 33, 34, also a rotating device 130 destined to take delivery of the piles thrust by the thrust device and rotate it by ninety degrees such as to bring it into a horizontal lie (see FIGS. 5 and 5').

In still more detail, this rotating device 130 is in particular provided such as to axially rotate the piles which are arranged vertically, with the length thereof orientated according to the thrust direction S.

The rotating device 130 comprises two rotating belts 51, 52 loop-wound about the respective rollers 50, which loops rotate in counter-rotation, the belts 51, 52 being arranged such as to be faced opposite and strictly adheringly along a rotating pathway R1, R2.

The rotating belts 51,52 are arranged vertical in a first tract R1 of the rotating pathway, while they are subjected to a progressive torsion by 90 degrees in the second rotating tract R2.

In practice, a pile 2 that arrives vertically arranged at the inlet Z will exit from the rotating device 130 arranged horizontally.

With the characteristics mentioned in relation to the arrangement of the rotating belts 51, 52 along the rotating pathway R1, R2, in particular in relation to the 90° torsion, the device 130 can be made in the same way as the conveyor protected by Italian patent no. 1376699, also object of European patent no. 2178780, which discloses the idea of obtaining the overturning of piles by means of belts subjected to a 180° torsion, a characteristic that is clearly not provided by the rotating device 130.

Downstream of the thrust device 31,32, 33, 34 and upstream of the rotating device 130 a pair of connecting belts 61, 62 can be comprised, arranged vertically and loop-wound and facing one another for a given length, with the length of the loop of one of the belts being greater than the length of the loop of the other, such that one of the connecting belts 61 projects with respect to the other both with respect to the initial end and the terminal end of a connecting pathway defined by the belts 61, 62 located adhering to one another.

Thus, the vertical pile 2 that is pushed by the thrust device in the thrust direction S is gripped in delivery by the connecting belts 61, 62 and taken, still vertical, up to the rotating device 130, which takes the pile between the rotating belts 51, 52 and draws it up to rotating it by 90 degrees following passage through the second tract R2 of the rotating pathway.

An expert in the sector knows the way in which to arranged the idle rollers and the motorised rollers such as to move and guide the two further and optional pairs of belts 51,52,61,62 just described.

When the pile 2 exits from the rotating device 130 it is delivered to other member, such as those denoted by 140 in FIGS. 5 and 5', which are for the operation of the stuffing station of the machine 100.

The above has been described by way of non-limiting example, and any constructional variations of the present technical solution are considered to fall within the protective scope of the present technical solution, as claimed in the following.

The invention claimed is:

1. An apparatus usable in an envelope stuffing machine for changing an initial advancement direction of piles made up of inserts to be stuffed in envelopes, comprising:

at least a thrust device for pushing a pile in a thrust direction, arrangeable in such as way that the thrust direction is perpendicular or oblique with respect to the initial advancement direction; and at least a connecting device comprising drawing means for transporting piles along a transport pathway, at a terminal end of which transport pathway there is an outlet of the connecting device, which drawing means are suitable for receiving piles which are supplied to the apparatus having said initial advancement direction, the drawing means being curved in such a way that the transport pathway comprises at least an arced tract with a centre of curvature located on a main axis perpendicular to the initial advancement direction, whereby, upon the crossing of the arced tract, the piles exhibit an intermediate advancement direction which is oblique or transversal with respect to the initial advancement direction;

wherein the thrust device is located downstream of the connecting device in a position in which it can receive the piles which exit from the connecting device, the device comprising at least two thrust elements rotatable about a respective vertical rotation axis, and each having a thrust surface, the two thrust elements being arranged with respect to one another in such a way that, upon the activation in counter-rotation of the thrust elements, the respective thrust surfaces are cyclically facing one another and at such a distance as to be able together to grab and push a pile in said thrust direction, wherein the thrust elements are located below the connecting device, and wherein the thrust device comprises a fixed lower base located below the thrust surfaces, and suitable for restingly receiving a side of the pile which falls between the two thrust devices.

2. The apparatus of claim 1, wherein the thrust elements are positioned in such a way that the ideal plane which comprises both vertical rotation axes thereof is perpendicular to the main axis, such that the thrust direction is perpendicular to the intermediate advancement direction and therefore perpendicular also to the initial advancement direction.

3. The apparatus of claim 1, wherein each thrust element comprises a protrusion which projects, having a lateral periphery that defines the thrust surface.

4. The apparatus of claim 1, comprising at least a lateral side-board located below the connecting device, and arranged superiorly of the lower base in such a position as to abut against a pile resting on the base, whereby preventing the pile from falling.

* * * * *